US010512814B1

(12) United States Patent
Conroy

(10) Patent No.: US 10,512,814 B1
(45) Date of Patent: Dec. 24, 2019

(54) EXERCISE DEVICES AND METHODS OF USE

(71) Applicant: Erin Conroy, Chicago, IL (US)

(72) Inventor: Erin Conroy, Chicago, IL (US)

( * ) Notice: Subject to any disclaimer, the term of this patent is extended or adjusted under 35 U.S.C. 154(b) by 108 days.

(21) Appl. No.: 15/821,596

(22) Filed: Nov. 22, 2017

Related U.S. Application Data

(60) Provisional application No. 62/425,125, filed on Nov. 22, 2016, provisional application No. 62/468,751, filed on Mar. 8, 2017.

(51) Int. Cl.

| | |
|---|---|
| ***A63B 21/055*** | (2006.01) |
| ***A63B 22/20*** | (2006.01) |
| ***A63B 21/00*** | (2006.01) |
| ***A63B 21/04*** | (2006.01) |
| ***A63B 23/035*** | (2006.01) |

(52) U.S. Cl.
CPC .... *A63B 21/0552* (2013.01); *A63B 21/00043* (2013.01); *A63B 21/00069* (2013.01); *A63B 21/0442* (2013.01); *A63B 21/4034* (2015.10); *A63B 21/4035* (2015.10);
(Continued)

(58) Field of Classification Search
CPC ... A63B 21/02; A63B 21/028; A63B 21/0355; A63B 21/045; A63B 21/00043; A63B 21/00058; A63B 21/0061; A63B 21/0065; A63B 21/00069; A63B 21/0442; A63B 21/0552; A63B 21/4034; A63B 21/4035; A63B 21/4043; A63B 21/04; A63B 21/0407; A63B 21/4033; A63B 21/05; A63B 21/055; A63B 21/0557; A63B 22/20; A63B 22/201; A63B 22/203; A63B 22/206; A63B 22/208; A63B 2210/50; A63B 2023/006; A63B 2022/0038; A63B 23/03516; A63B 23/0355;
(Continued)

(56) References Cited

U.S. PATENT DOCUMENTS 3,584,871 A * 6/1971 Kelmon, Jr. ..... A63B 21/0004 482/123
4,132,404 A * 1/1979 Wilson ..... A63B 23/0488 482/132
(Continued)

OTHER PUBLICATIONS

Screen captures from YouTube video clip entitled "Exercise of the Day: Ab Slide with Gliders," 2 pages, uploaded on Mar. 31, 2009 by user "AthleKinetix". Retrieved from Internet: < https://www.youtube.com/watch?v=jurt4OzSI9w>. (Year: 2009).*
(Continued)

*Primary Examiner* — Joshua Lee
*Assistant Examiner* — Zachary T Moore
(74) *Attorney, Agent, or Firm* — McDonnell Boehnen Hulbert & Berghoff LLP

(57) ABSTRACT

Various exercise devices and methods of use are disclosed herein. In one example, an exercise device includes a first platform and a second platform. The first platform includes one or more feet configured to interface with and remain static with a support surface. The second platform includes one or more wheels configured to roll on the support surface. An elastic coupling is arranged between the first platform and the second platform, and the elastic coupling is configured to transition from a relaxed condition to a tensioned condition as the second platform is advanced away from the first platform.

20 Claims, 12 Drawing Sheets

(52) U.S. Cl.
CPC ..... *A63B 21/4043* (2015.10); *A63B 22/20* (2013.01); *A63B 23/0355* (2013.01); *A63B 2210/50* (2013.01)

(58) Field of Classification Search
CPC ..... A63B 23/03508; A63B 23/0482; A63B 23/0488; A63B 23/0494
USPC ..... 482/132, 146
See application file for complete search history.

(56) References Cited

U.S. PATENT DOCUMENTS 5,158,512 A * 10/1992 Irwin ..... A63B 23/0458 482/142
6,733,428 B2 * 5/2004 List ..... A63B 21/0552 482/121
7,112,168 B2 * 9/2006 Dalebout ..... A63B 22/18 482/146
8,382,645 B2 * 2/2013 Mylrea ..... A63B 21/0004 482/148
2003/0213878 A1 * 11/2003 Stahl ..... B62B 3/1476 248/129
2013/0288866 A1 * 10/2013 Rainey ..... A63B 26/003 482/146
2014/0031183 A1 * 1/2014 Blake ..... A63B 21/04 482/130

OTHER PUBLICATIONS

Screen captures from YouTube video clip entitled "Fun with Furniture Sliders: Hamstring Curls," 2 pages, uploaded on Dec. 2, 2015 by user "InvictusFitness". Retrieved from Internet: <https://www.youtube.com/watch?v=MRwP51IdAXg>. (Year: 2015).*
Balanced Body, "Pilates Reformers," https://www.pilates.com/BBAPP/V/store/pilates-reformers.html (last visited Nov. 22, 2017).
Flyte Fitness, "CoreFlyte Dynamic Stability Trainers," www.flytefitness.com (last visited Nov. 22, 2017).

* cited by examiner

EXERCISE DEVICES AND METHODS OF USE

CROSS-REFERENCE TO RELATED APPLICATIONS

This application claims priority to U.S. Provisional Application No. 62/425,125 filed on Nov. 22, 2016 and U.S. Provisional Application No. 62/468,751 filed on Mar. 8, 2017, both of which are incorporated herein by reference in their entirety.

BACKGROUND

Physical exercise can provide several benefits for improving a person's quality of life. For instance, regular physical exercise can help in maintaining a healthy weight, lowering risk of disease, improving mood or self-esteem, boosting energy, and promoting better sleep.

One type of physical exercise is Pilates, which includes performing controlled movements designed to improve flexibility, build strength, and develop control and endurance in the entire body. Pilates exercises can be performed with the aid of exercise devices called "reformers."

SUMMARY

The systems and methods disclosed herein provide improvements to exercise devices and their methods of use. In particular, the example exercise devices of the present disclosure can be less costly, smaller in size (e.g., smaller profile, footprint, weight, etc.), and collapsible for easy transport. Further, the devices can be used to perform various types of exercises, including various types of Pilates exercises.

In one aspect, an exercise device is disclosed. The exercise device includes a first platform, a second platform having one or more wheels, and an elastic coupling arranged between the first platform and the second platform. The elastic coupling is configured to transition from a relaxed condition to a tensioned condition as the second platform is advanced away from the first platform.

In another aspect, another exercise device is disclosed. The exercise device includes a first platform comprising a first surface and a second surface on opposing sides of the first platform. The exercise device also includes a second platform comprising a first surface and a second surface on opposing sides of the second platform, where the first surface and the second surface of the first platform are configured to remain static when in contact with a support surface and the first surface and the second surface of the second platform are configured to be moveable when in contact with the support surface. Further, the exercise device includes an elastic coupling arranged between the first platform and the second platform, the elastic coupling being configured to transition from a relaxed condition to a tensioned condition as the second platform is advanced away from the first platform.

In another aspect, another exercise device is disclosed. The exercise device includes a first platform, a second platform, and an elastic coupling arranged between the first platform and the second platform, the elastic coupling being configured to transition from a relaxed condition to a tensioned condition as the second platform is advanced away from the first platform.

In another aspect, another exercise device is disclosed. The exercise device includes a first platform configured to interface with a support surface and a second platform comprising an interfacing surface removably coupled to the second platform, where the interfacing surface is configured to interface with the support surface. The exercise device further includes an elastic coupling arranged between the first platform and the second platform, the elastic coupling being configured to transition from a relaxed condition to a tensioned condition as the second platform is advanced away from the first platform.

In another aspect, a method of exercising is disclosed. The method can be carried out using any of the exercise devices disclosed herein having a first platform, a second platform, and an elastic coupling arranged between the first platform and the second platform. The method includes arranging the exercise device such that at least one surface of the first platform and at least one surface of the second platform interface with a support surface. The method then includes advancing the second platform away from the first platform, thereby increasing a tension of the elastic coupling.

These, as well as other aspects, advantages, and alternatives, will become apparent to those of ordinary skill in the art by reading the following detailed description, with reference where appropriate to the accompanying drawings.

DETAILED DESCRIPTION

I. Overview

Example exercise devices as well as methods of use are described herein. Any example embodiment or feature described herein is not necessarily to be construed as preferred or advantageous over other embodiments or features. The example embodiments described herein are not meant to be limiting. It will be readily understood that certain aspects of the disclosed methods can be arranged and combined in a wide variety of different configurations, all of which are contemplated herein.

Furthermore, the particular arrangements shown in the figures should not be viewed as limiting. It should be understood that other embodiments may include more or less of each element shown in a given figure. Further, some of the illustrated elements may be combined or omitted. Yet further, an example embodiment may include elements that are not illustrated in the figures.

II. Example Systems and Methods

Figure 1:
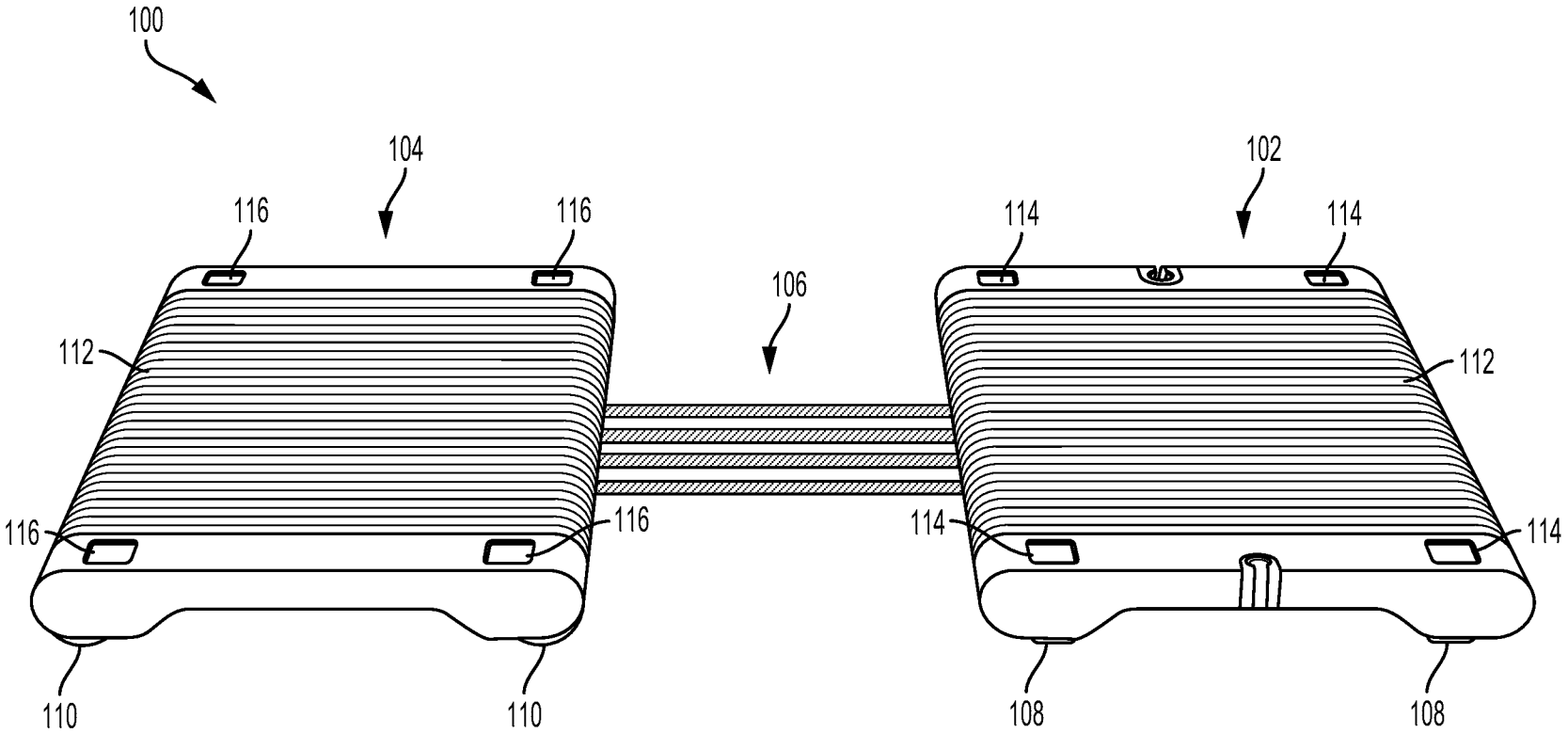
FIG. 1 illustrates an exercise device, according to an example embodiment.

Referring to FIGS. 1-6, various examples of an exercise device 100 are shown. As shown in FIG. 1, the exercise device 100 includes a first platform 102, a second platform 104, and an elastic coupling 106. The elastic coupling 106 is arranged at least partially between the first platform 102 and the second platform 104 and couples the first platform 102 to the second platform 104. As used herein, "elastic" refers to the capability of a material to substantially resume its original shape after being stretched, deformed, compressed, or expanded. As such, an elastic material may be placed under tension, thereby inducing resistance against movement. Accordingly, it should be understood that the elastic coupling 106 may be a variety of different materials. The elastic coupling 106 as shown includes four elastic bands, but in other examples the elastic coupling 106 may include additional or fewer bands or other types of elastic coupling. For instance, the elastic coupling 106 may include any number of elastic cords, straps, links, ropes, chains, or any other elastic mechanism for coupling the first platform 102 to the second platform 104.

A tension of the elastic coupling 106 may vary based on a position of the first platform 102 relative to the second platform 104. For instance, the elastic coupling 106 may be in a relaxed condition when no external forces are applied to the first platform 102 or the second platform 104, and the elastic coupling 106 may transition to a tensioned condition as the second platform 104 is advanced away from the first platform 102. As used herein, "relaxed condition" refers to a relaxed, un-tensioned condition of the elastic coupling 106 when the first platform 102 and the second platform 104 are not being forced away from one another, and "tensioned condition" refers to a condition of the elastic coupling 106 when the first platform 102 and the second platform 104 are advanced away from each other, thereby increasing a tension or resistance of the elastic coupling 106.

In practice, a user may use the device 100 to exercise by exerting a force on the second platform 104 to advance the second platform 104 away from the first platform 102, or vice versa. As the user advances the second platform 104 away from the first platform 102, the elastic coupling 106 enters a tensioned condition in which the elastic coupling 106 resists further advancement of the second platform 104 away from the first platform 102. Accordingly, the user must exert additional force to continue to advance the second platform 104. After advancing the second platform 104 away from the first platform 102 by a desired distance, the user may reduce the amount of force applied to the second platform 104, allowing a tensile force of the elastic coupling 106 to pull the second platform 104 back toward the first platform 102. In order to prevent the second platform 104 from rapidly jerking back toward the first platform 102, the user may continue to apply a force that partially resists the tensile force of the elastic coupling 106, causing the second platform 104 to smoothly retreat back toward the first platform 102. In this manner, the user exerts energy when advancing the second platform 104 away from the first platform 102 and also when allowing the second platform 104 to retreat back toward the first platform 102. Because there are numerous different ways in which the user can move the second platform 104 relative to the first platform 102, there are numerous different exercises that can be performed using the exercise device 100.

Figure 2:
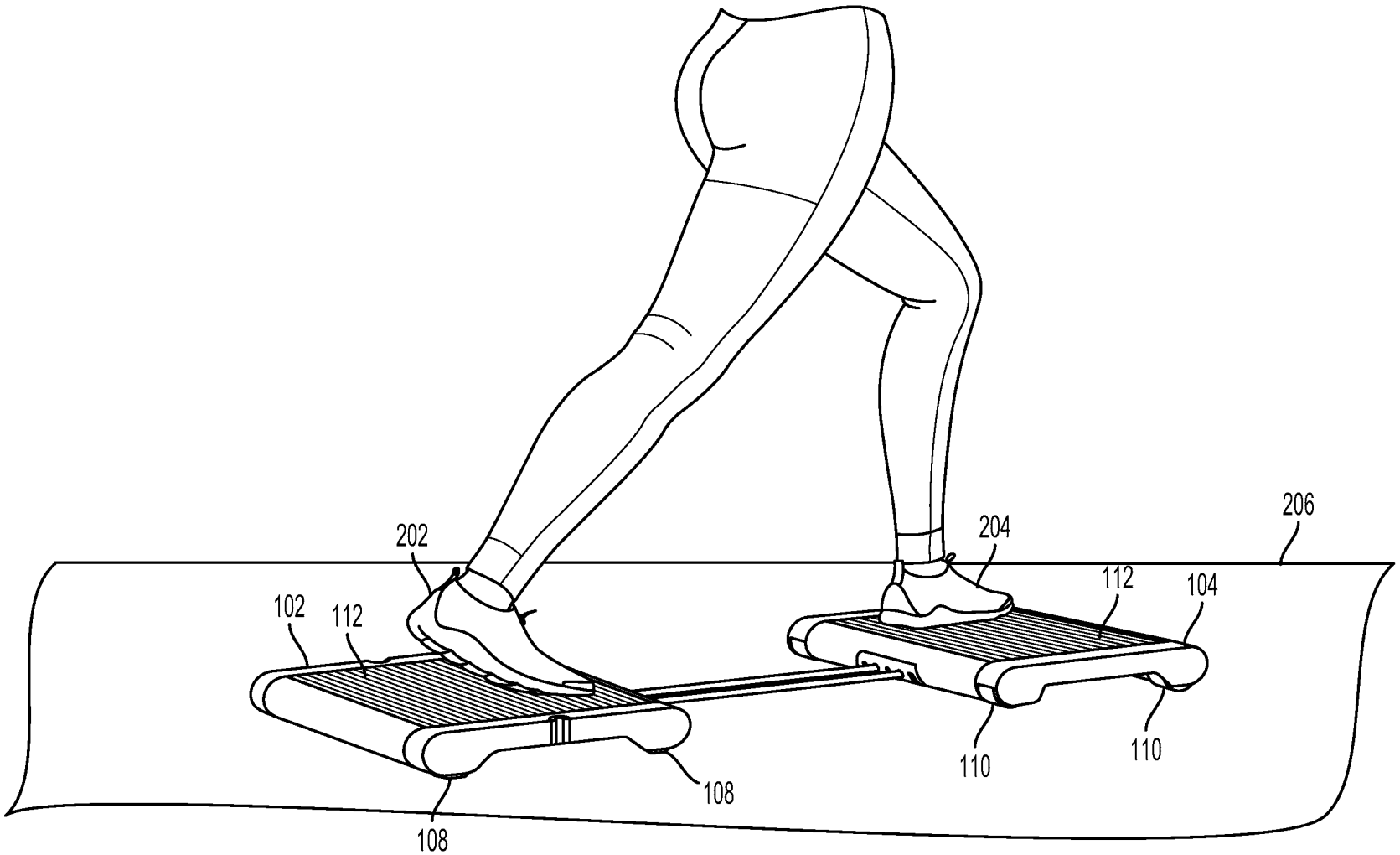
FIG. 2 illustrates a user using the exercise device of FIG. 1, according to an example embodiment.

FIG. 2 illustrates an example of a user using the exercise device 100 to perform an exercise. As shown, the user may place their first foot 202 on the first platform 102, place their second foot 204 on the second platform 104, and perform a leg lunge exercise or a leg split exercise in order to advance the second platform 104 away from the first platform 102. In another example, the user may place their shoulder(s) or upper back on the first platform 102, place their foot on the second platform 104, and perform a pelvic lift exercise in order to advance the second platform 104 away from the first platform 102. In yet another example, the user may place their knee on the first platform 102, place their hand on the second platform 104, and advance the second platform 104 away from the first platform 102 by moving their hand away from their knee. In still another example, the user may place their foot on the first platform 102, place their hand on the second platform 104, and advance the second platform 104 away from the first platform 102 by moving their hand away from their foot. Other examples are possible as well. Further, in the above examples, where an example includes placing a body part on the first platform 102, the example could alternatively include placing the body part on the second platform 104 and vice versa.

Additionally, when advancing the second platform 104 away from the first platform 102, the second platform 104 may be moved in a variety of directions. For instance, the second platform 104 may be advanced along a longitudinal axis that extends lengthwise between the first and second platforms. Alternatively or additionally, the second platform 104 may be advanced along a lateral axis that is orthogonal to the longitudinal axis (e.g., side to side). Further, the second platform 104 may be advanced away from the first platform 102 in a diagonal or oblique direction. Other examples are possible as well.

In order to facilitate the above example exercises or other exercises, the device 100 may be arranged on a support surface 206. The support surface 206 could be any surface that supports the exercise device 100, including but not limited to, a floor surface, a ground surface, or the like, that the exercise device 100 may be placed against in use.

In practice, the first platform 102 may be configured to remain static when in contact with the support surface 206, while the second platform 104 may be configured to be moveable when in contact with the support surface 206. For instance, a bottom side of the first platform 102 may include one or more feet 108, and a bottom side of the second platform 104 may include one or more wheels 110. In such an arrangement, the feet 108 of the first platform 102 may be configured to grip the support surface 206, and the wheels 110 of the second platform 104 may be configured to roll across the support surface 206.

Because the support surface 206 may take various forms (e.g., a hardwood, tile, linoleum, or carpeted floor surface), the feet 108 of the first platform 102 may include or be composed of various materials for interfacing with different types of support surfaces 206. For instance, in order to remain static when in contact with the support surface 206, the feet 108 of the first platform 102 may include or be composed of a material having a high coefficient of friction (e.g., greater than 0.5) relative to both hard and soft floor surfaces. Such a material could include various types of rubber or other high-friction polymers. Other examples are possible as well.

Further, because many of the exercises described above involve the user standing on one or both of the first platform 102 and second platform 104, the first and second platforms may each include a textured surface 112 for interfacing with a foot or shoe of the user. The textured surface 112 may be configured to grip the foot or shoe of the user so that the user does not slip off of the exercise device 100 when exercising. As such, the textured surface 112 may include a number of ridges or other protruding elements to increase the friction of the textured surface 112. Further, the textured surface may include or be composed of a material that has a high coefficient of friction (e.g., greater than 0.5) when interfacing with shoe soles and/or feet. Such a material could include various types of rubber or other high-friction polymers.

In some examples, the exercise device 100 may facilitate other exercises in addition to those described above. For example, the exercise device 100 may be configured to interface with one or more resistance bands for performing various resistance band exercises.

Figure 3:
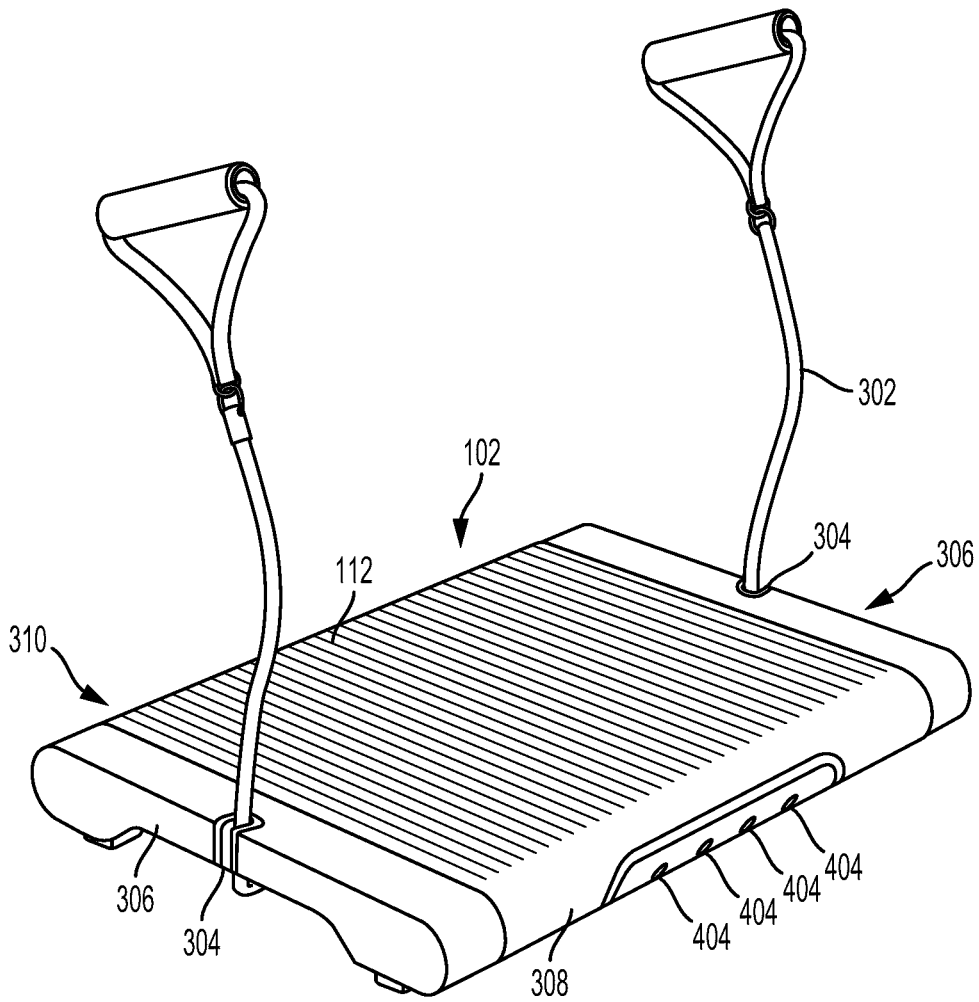
FIG. 3 illustrates a bottom view of a platform of the exercise device of FIG. 1, according to an example embodiment.

FIG. 3 illustrates the exercise device 100 interfacing with a resistance band 302. As shown, the first platform 102 includes an interface, depicted as a pair of slots 304, for receiving the resistance band 302. The slots 304 may be located on lateral sides 306 of the first platform 102 between a bottom side and top side of the first platform 102. In this manner, the resistance band 302 can be wrapped around the bottom side of the first platform 102 and fed up through the slots 304 on the lateral sides 306 of the first platform so that the ends or handles of the resistance band 302 are accessible by a user standing on the top side of the first platform 102. As shown, the slots 304 are located proximate to the centers of the lateral sides 306 of the first platform 102. However, other configurations are possible as well. For instance, the slots 304 may be located on the lateral sides 306 closer to a front side 308 or a rear side 310 of the first platform 102.

The slots 304 may have a diameter approximately equal to, or slightly larger than, a diameter of the resistance band 304 so that the resistance band 304 may fit snugly in the slots 304. Further, the slots 304 may have openings that are slightly thinner than the diameter of the resistance band 302. In this manner, the slot openings may be wide enough to allow a user to squeeze the band into the slots 304 due to the elasticity of the resistance band 302, and the slot openings may be sufficiently narrow to help prevent the resistance band 302 from sliding out of the slots 304 during use.

Once the resistance band 302 is attached to the exercise device 100, for example using the slots 304, the user can perform a variety of resistance band exercises. For instance, the user can stand on the first platform 102, grabbing the resistance band 302 with one or both hands, and perform various resistance band exercises, such as biceps curls, triceps extensions, overhead presses, forward/lateral raises, upright rows, or the like. In some examples, the user may perform the resistance band exercises in parallel with the exercises described above that involve moving the second platform 104 relative to the first platform 102. For instance, the user may sit on the first platform 102, grabbing the resistance band 302 with one or both hands and placing the user's feet on the second platform 104. The user can then perform various resistance band arm exercises while using the user's legs and feet to advance the second platform 104 away from the first platform. Alternatively, the user may sit on the second platform 104, placing the user's feet on the first platform 102 while grabbing the resistance band 302 with one or both hands. The user can then perform various resistance band exercises while advancing the second platform 104 away from the first platform 102 by extending the user's legs and pushing off of the first platform 102. Other examples are possible as well.

The exercise device 100 may include a number of features for increasing the portability of the device. For instance, various components of the device 100 may be detachable and storable in various compartments of the device. Further, various components of the device 100 may be stackable, or otherwise interlock, in order to make the device 100 easier to carry.

Figure 4:
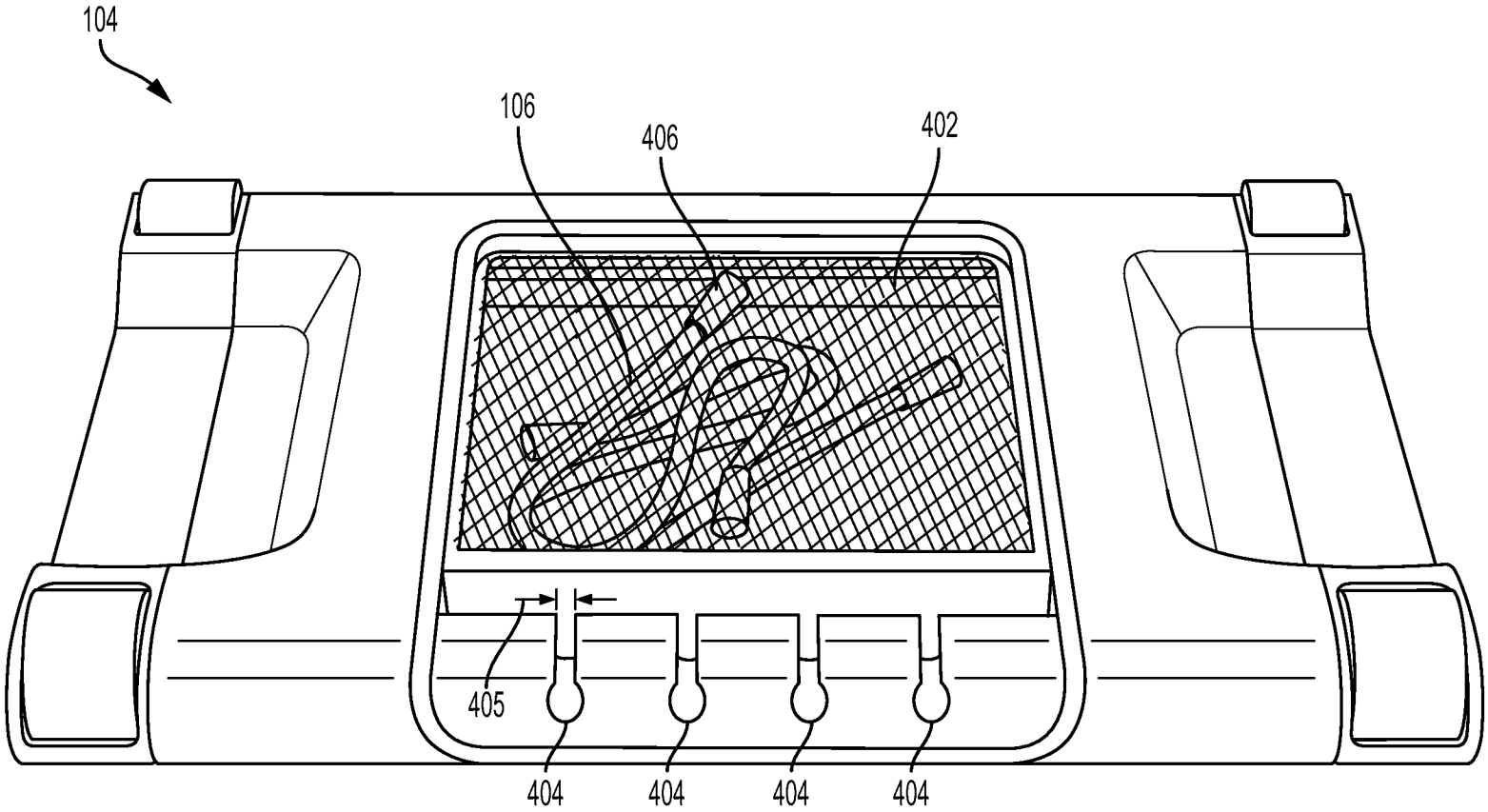
FIG. 4 illustrates a platform of the exercise device of FIG. 1, according to an example embodiment.

FIG. 4 illustrates the bottom side of the second platform 104, according to an example embodiment. The bottom side of the second platform 104 includes a compartment 402 for storing the elastic coupling 106 when the device 100 is not in use. As shown, the elastic coupling 106 is secured within the compartment 402 by a mesh covering, but other examples are possible as well. The compartment 402 is shown as part of the second platform 104 for illustrative purposes only. In other examples, the compartment 402 may additionally or alternatively be included as part of the first platform 102 and can be similarly arranged on the bottom side of the first platform 102. Further, in some examples, the second platform 104 may not include the compartment 104 and may instead use only the mesh covering to act as a pouch that stores the elastic coupling 106 against the bottom side of the second platform 104.

In order to store the elastic coupling 106 within the compartment 402, the elastic coupling 106 may be removably coupled to the first platform 102 and the second platform 104. To facilitate this, the first platform 102 and the second platform 104 may include a number of slots 404 for receiving the elastic coupling 106. FIG. 4 only depicts the slots 404 in the second platform 104 for illustrative purposes, but it will be understood that the slots 404 may be included in the first platform 102 as well (see, e.g., FIG. 3).

Similar to the slots 304 depicted in FIG. 3, the slots 404 for receiving the elastic coupling 106 may each have a diameter that is approximately equal to, or slightly larger than, a diameter of the elastic coupling 106, and the slots 404 may each have an opening 405 that is slightly smaller than the diameter of the elastic coupling 106 in order to help secure the elastic coupling within the slots 404.

Additionally, in order to further secure the elastic coupling 106 within the slots 404, the elastic coupling 106 may include one or more stoppers 406 proximate to the ends of the elastic coupling 106. The stoppers 406 may be enlarged portions of the elastic coupling 106 that have a diameter that is larger than the diameter of the slots 404 such that the stoppers 406 are unable to slide through the slots 404. In this manner, when the elastic coupling 106 is inserted into and received by the slots 404, the stoppers 406 of the elastic coupling 106 may abut the slots 404, thereby preventing the elastic coupling 106 from sliding completely through and out of the slots 404. In some examples, each elastic band of the elastic coupling 106 may include multiple stoppers 406 proximate to one or both ends of the elastic band. This may allow a user to customize a resistance of the elastic band by adjusting which stopper 406 abuts the slots 404.

In some examples, as noted above, the exercise device may include stackable components. For instance, the first platform 102 may be stacked on top of the second platform 104 and/or the second platform 104 may be stacked on top of the first platform 102.

Referring back to FIG. 1, the first platform 102 may include a number of receptacles 114 on the top side of the first platform 102. The receptacles 114 may be arranged in a pattern and shape that corresponds to a footprint of the wheels 110 of the second platform 104. In this manner, when the second platform 104 is stacked onto the first platform 102, the wheels 110 of the second platform 104 may align with, and be received by, the receptacles 114 of the first platform 102. Similarly, the second platform 104 may include a number of receptacles 116 on the top side of the second platform 104. The receptacles 116 may be arranged in a pattern and shape that corresponds to a footprint of the feet 108 of the first platform 102. In this manner, when the first platform 102 is stacked onto the second platform 104, the feet 108 of the first platform 102 may align with, and be received by, the receptacles 116 of the second platform 104.

In some examples, the first and second platforms 102, 104 may be stackable in other configurations. For instance, the first and second platforms 102, 104 may be stackable such that the bottom sides of each platform are facing each other. To facilitate this, the receptacles 114 of the first platform 102 may be arranged on the bottom side of the first platform 102. Additionally or alternatively, the receptacles 116 of the second platform 104 may be arranged on the bottom side of the second platform 104. In these examples, the feet 108 of the first platform 102 and the wheels 110 of the second platform 104 may be offset from one another such that the feet 108 and the wheels 110 do not intersect when the bottom sides of the first and second platforms 102, 104 are brought together.

Figure 5A:
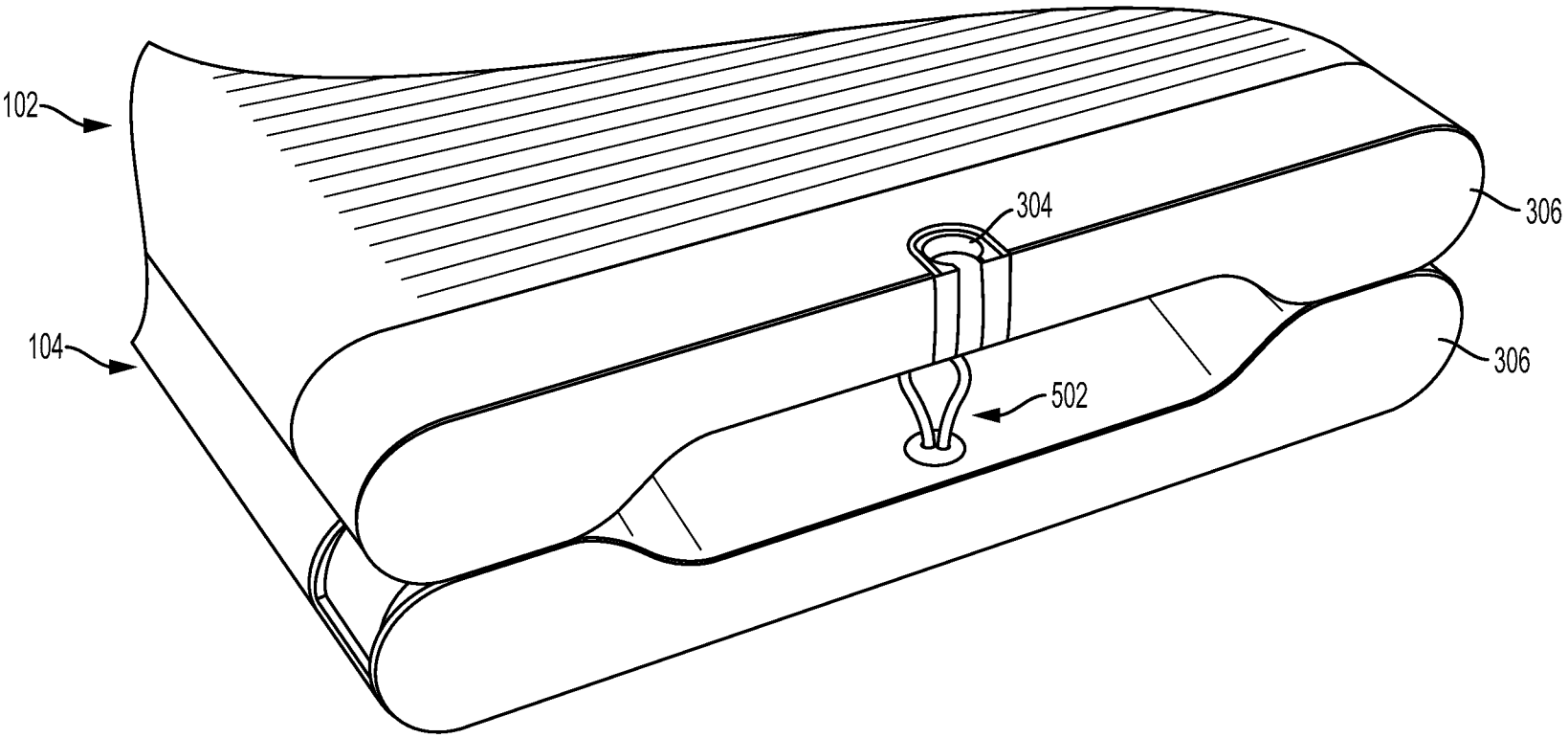
FIG. 5A illustrates the exercise device of FIG. 1 arranged in a stacked configuration, according to an example embodiment.

The exercise device 100 may further include various mechanisms for securing the first platform 102 and the second platform 104 together once they are stacked. For instance, as shown in FIG. 5A, the second platform 104 may include one or more restraints 502 configured to secure the first platform 102 to the second platform 104 by interfacing with the slots 304 in the lateral sides 306 of the first platform 102. The restraints 502 may be located on the bottom side of the second platform 104 near the lateral sides 306 so that the restraints 502 align with the slots 304 of the first platform 102. FIG. 5A only illustrates one restraint 502 on one lateral side 306 of the second platform 104, but this is for illustrative purposes only and is not meant to be limiting. It will be understood that the second platform 104 may further include an additional restraint 502 near the opposite lateral side 306 of the second platform 104 such that the additional restraint 502 aligns with the other slot 304 of the first platform 102.

Figure 5B:
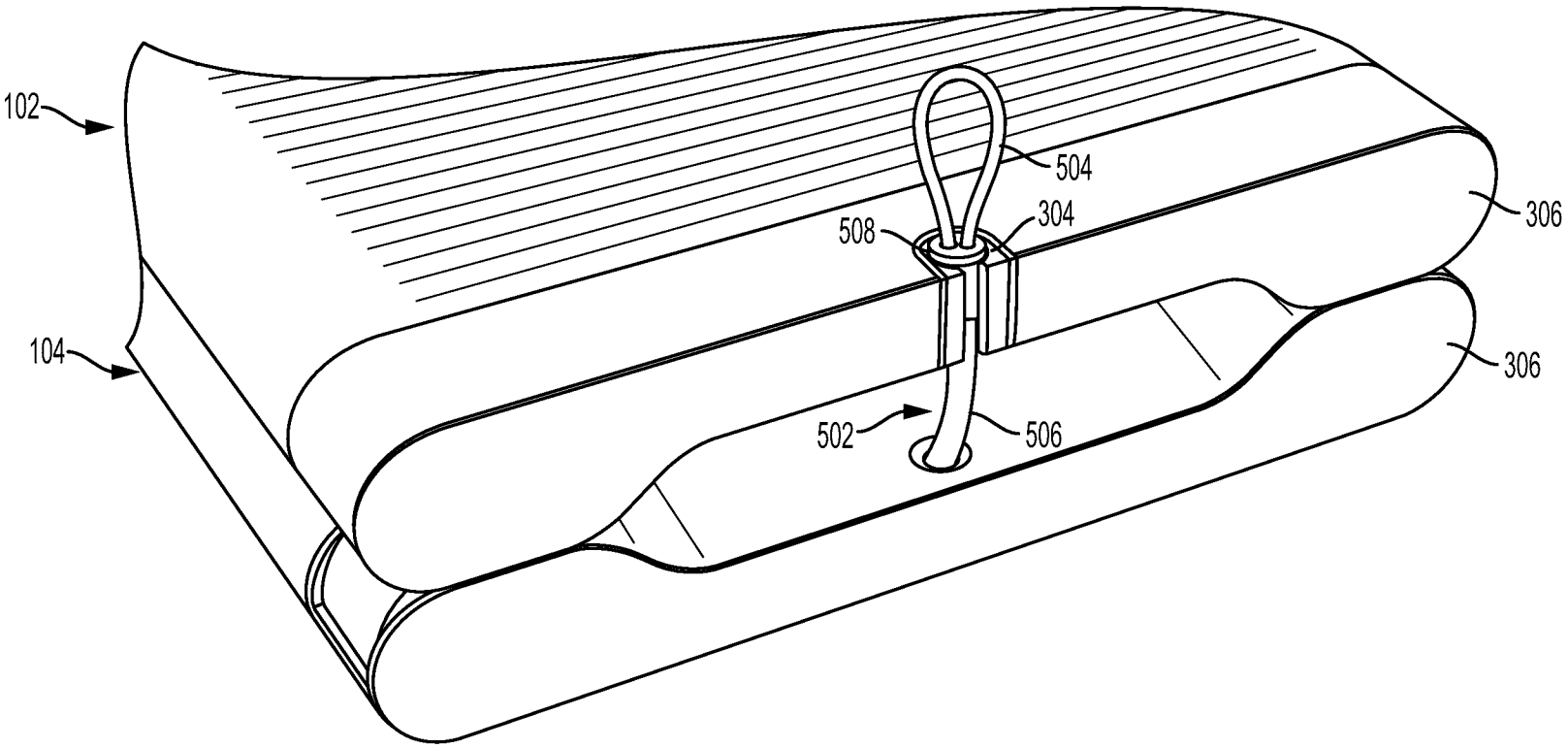
FIG. 5B illustrates the exercise device of FIG. 1 arranged in a stacked configuration, according to an example embodiment.

FIG. 5B next illustrates the exercise device 100 with the restraint 502 of the second platform 104 secured within the slot 304 of the first platform 102. In order to secure the restraint 502 within the slot 304, a user may pull on a handle 504 of the restraint 502 in order to extend the restraint 502 out of and away from the second platform 104. The restraint 502 may include a retractable band 506 that extends from the second platform 104 when the user pulls on the restraint 502 and retracts back into the second platform 104 when the user releases the restraint. For instance, the retractable band 506 may be an elastic band that stretches as the user pulls on the restraint 502, or the retractable band 506 may take various other forms, such as a spring-loaded cable.

Once the retractable band 506 is extended from the second platform 104, the restraint 502 can be inserted into and received by the slot 304 of the first platform 102. The restraint 502 may include a stopper 508 for preventing the restraint 502 from sliding through the slot 304, similar to, or the same as, the stoppers 406 that secure the elastic coupling 106 within the slots 404 of the first and second platforms. When inserted into the slot 304, the restraint 502 is under tension, as the retractable band 506 attempts to retract back into the second platform 104. This tensile force acts to secure the first platform 102 to the second platform 104.

Figure 6:
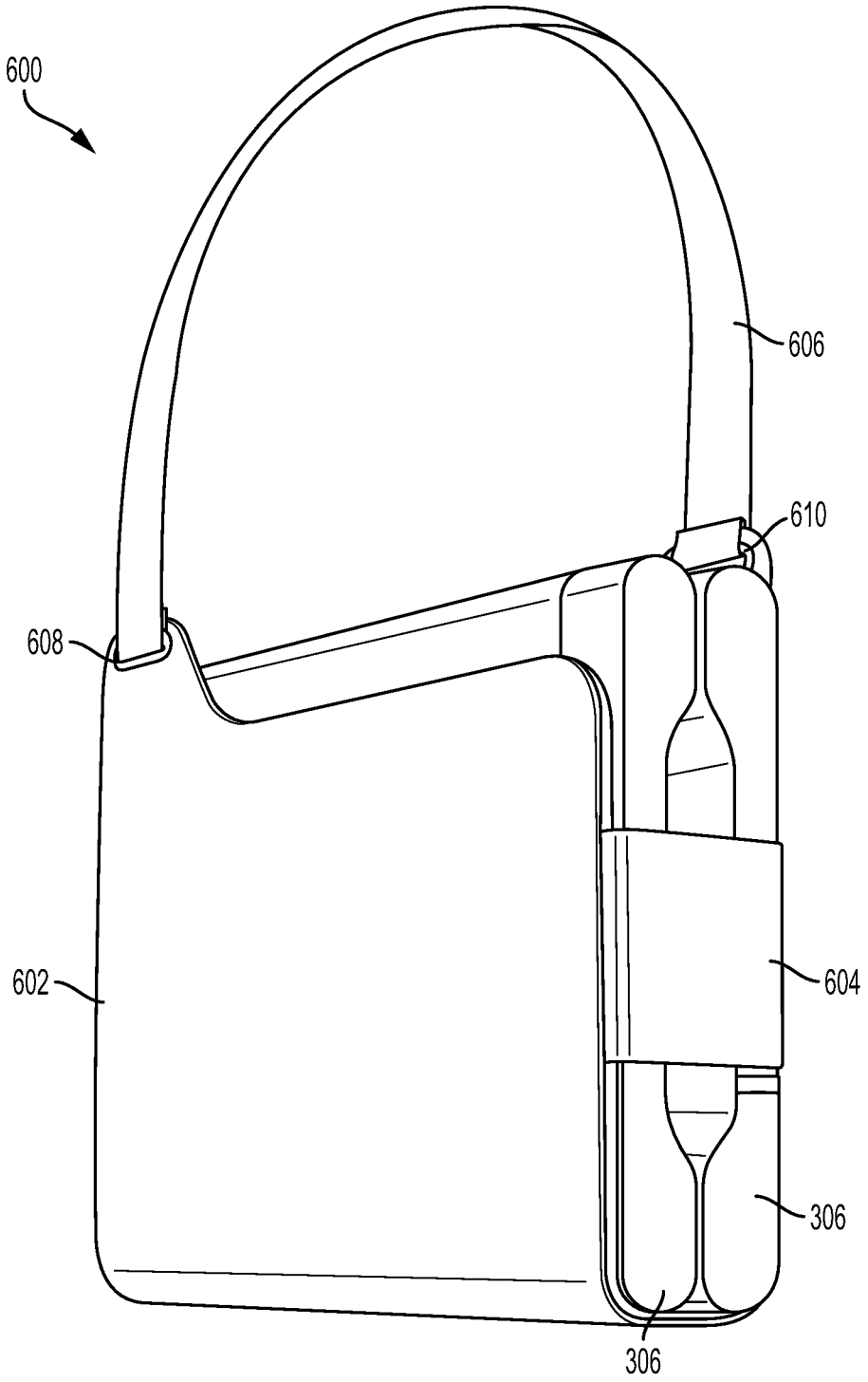
FIG. 6 illustrates the exercise device of FIG. 1 arranged in a carrying case, according to an example embodiment.

FIG. 6 next illustrates a carrying case 600 for carrying the exercise device 100, according to an example embodiment. The carrying case 600 includes a single sheet 602 of flexible material, such as fabric, plastic, woven material, or the like. The single sheet 602 wraps around the top and/or bottom sides of the exercise device 100 when the first platform 102 and the second platform 104 are stacked together. The carrying case 600 further includes latches 604 for securing the single sheet 602 to itself by wrapping around the lateral sides 306 of the exercise device 100. The latches 604 may secure the single sheet 602 to itself using various types of securing mechanisms, such as pins, buttons, a hook and loop or burr material, such as Velcro brand material, or the like. The carrying case 600 further includes a handle 606 coupled to the single sheet 602 at a first handle coupling 608 and a second handle coupling 610. When the carrying case is encapsulating the exercise device 100, the first handle coupling 608 is located proximate to a first lateral edge of the first platform 102, and the second handle coupling 610 is located proximate to a second lateral edge of the second platform 104, such that the first lateral edge of the first platform 102 is diagonally opposite the second lateral edge of the second platform 104.

FIGS. 7-10 next illustrate another exercise device 700, according to example embodiments. It will be understood that some or all of the features described above with respect to exercise device 100 may also be incorporated into exercise device 700, and vice versa.

Figure 7:
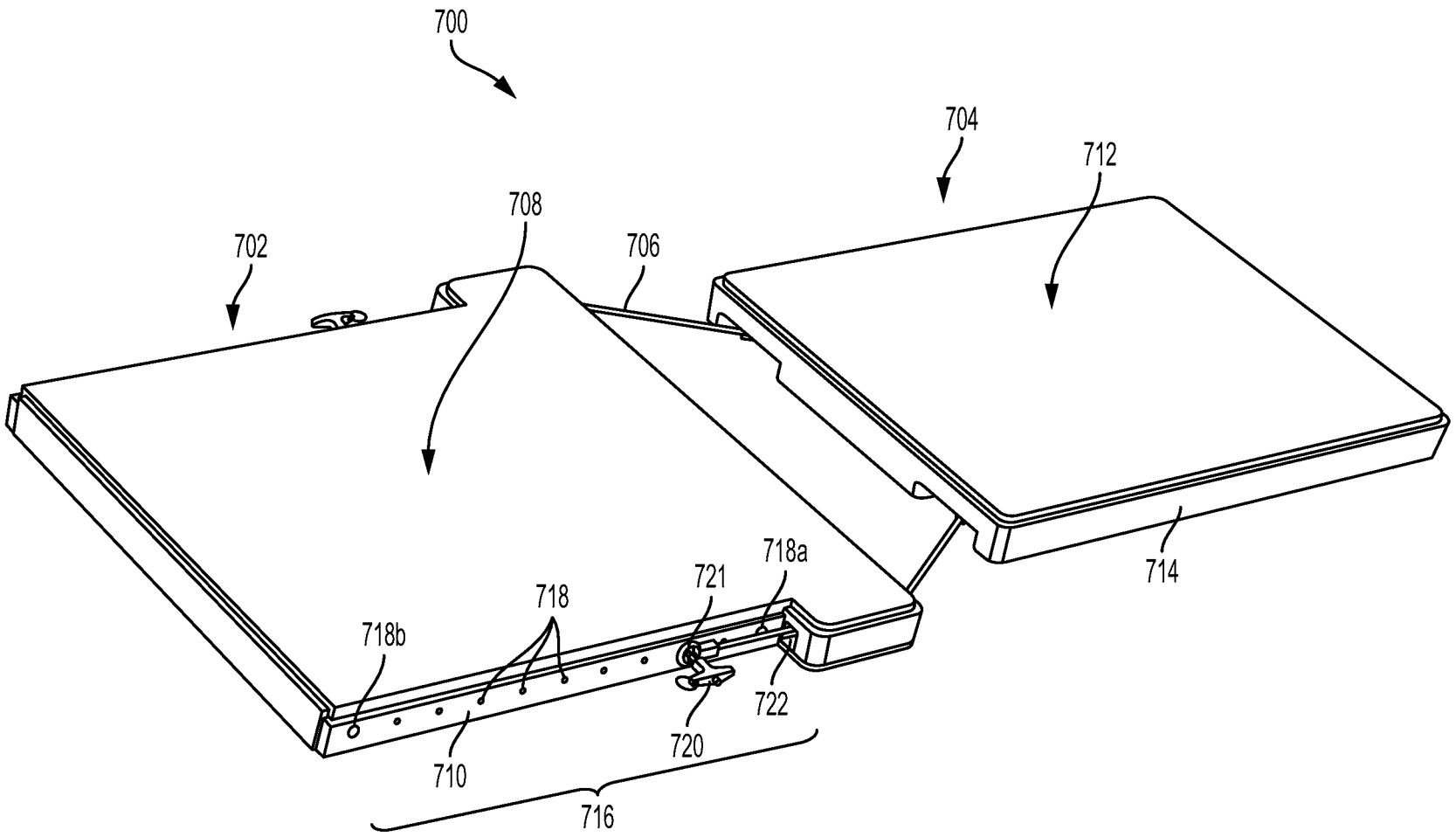
FIG. 7 illustrates another exercise device, according to an example embodiment.

Referring to FIG. 7, an example of the exercise device 700 is shown. The exercise device 700 includes a first platform 702, a second platform 704, and an elastic coupling 706.

Figure 8:
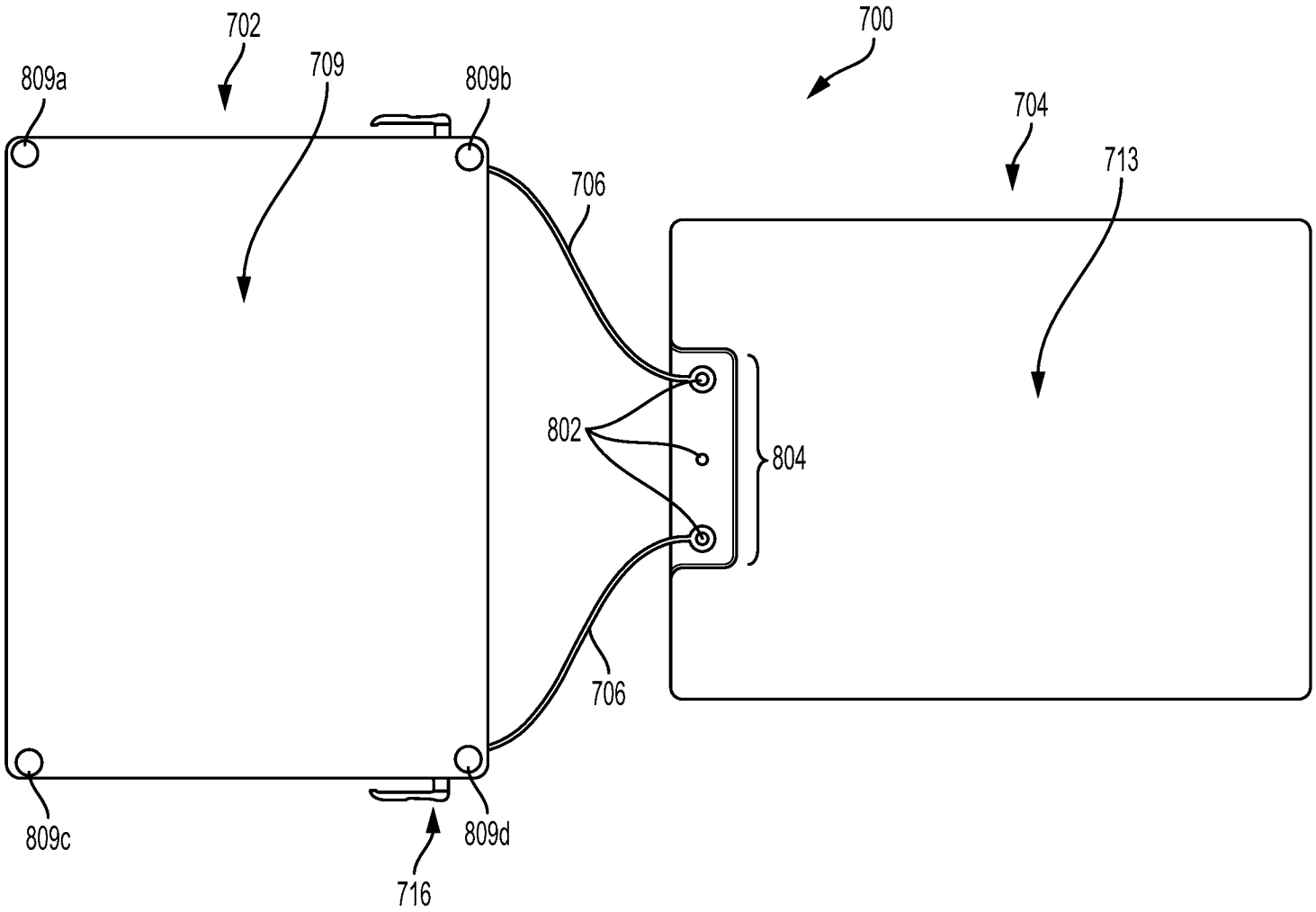
FIG. 8 is a bottom view of an exercise device, according to an example embodiment

The first platform 702 includes a top surface 708, one or more side surfaces 710, and a bottom surface 709 (see, e.g., FIG. 8). Similarly, the second platform 704 includes a top surface 712, one or more side surfaces 714, and a bottom surface 713 (see, e.g., FIG. 8). The first platform 702 and the second platform 704 may be configured to interface with a support surface, such as the support surface 206. In line with the discussion above, the support surface 206 could be any surface that supports the exercise device 700, including but not limited to, a floor surface, ground surface, or the like, that the exercise device 700 may be placed against in use.

In practice, the first platform 702 may be configured to remain static when in contact with the support surface 206, while the second platform 704 may be configured to be moveable when in contact with the support surface 206. For instance, the exercise device 700 may be arranged such that both the bottom surface 709 of the first platform 702 and the bottom surface 713 of the second platform 704 are in contact with the support surface 206. In such an arrangement, the bottom surface 709 of the first platform 702 may be configured to grip the support surface 206, and the bottom surface 713 of the second platform 704 may be configured to slide across the support surface 206. Similarly, if the exercise device 700 is arranged such that both the top surface 708 of the first platform 702 and the top surface 712 of the second platform 704 are in contact with the support surface 206, then the top surface 708 of the first platform 702 may be configured to grip the support surface 206, and the top surface 712 of the second platform 704 may be configured to slide across the support surface 206.

Because the support surface 206 may take various forms (e.g., a hardwood, tile, linoleum, or carpeted floor surface), the top surfaces 708, 712 and the bottom surfaces 709, 713 of the first and second platforms 702, 704 may include or be composed of various materials for interfacing with different types of support surfaces 206.

For instance, the bottom surfaces 709, 713 of the first and second platforms 702, 704 may be configured to interface with a hard floor surface, such as hardwood, tile, linoleum, or the like. As such, in order for the bottom surface 709 of the first platform 702 to grip the hard floor surface, the bottom surface 709 of the first platform 702 may include or be composed of a material having a high coefficient of friction (e.g., greater than 0.5) relative to one or more hard floor surfaces. Such a material could include various types of rubber or other high-friction polymers. Conversely, in order for the bottom surface 713 of the second platform 704 to slide across the hard floor surface, the bottom surface 713 of the second platform 704 may include or be composed of a material having a low coefficient of friction (e.g., less than 0.5) relative to one or more hard floor surfaces. Such a material could include various types of fabric (e.g., cotton, felt, polyester, carpet, etc.) or other soft materials.

Further, the top surfaces 708, 712 of the first and second platforms 702, 704 may be configured to interface with a soft floor surface, such as carpet, rugs, or the like. As such, in order for the top surface 708 of the first platform 702 to grip the soft floor surface, the top surface 708 of the first platform 702 may include or be composed of a material having a high coefficient of friction (e.g., greater than 0.5) relative to one or more soft floor surfaces. Such a material could include a hook and loop or burr material, such as Velcro brand material, or various types of rubber or other high-friction polymers. Conversely, in order for the top surface 712 of the second platform 704 to slide across the hard floor surface, the top surface 712 of the second platform 704 may include or be composed of a material having a low coefficient of friction (e.g., less than 0.5) relative to one or more soft floor surfaces. Such a material could include various types of plastic, wood, metal or other hard and smooth materials.

Accordingly, in the above examples, the exercise device 700 may be configured to interface with multiple different support surfaces 206 by changing which surfaces of the exercise device 700 contact the support surface 206.

As noted above, the exercise device 700 further includes an elastic coupling 706, which is arranged at least partially between the first platform 702 and the second platform 704 and couples the first platform 702 to the second platform 704. The elastic coupling 706 may be similar to, or the same as, the elastic coupling 106 described above with respect to exercise device 100. As such, the elastic coupling 706 may be any of a variety of different materials capable of substantially resuming its original shape after being stretched, deformed, compressed, or expanded. The elastic coupling 706 as shown includes two elastic bands, but in other examples the elastic coupling 706 may include additional or fewer bands or other types of elastic coupling. For instance, the elastic coupling 706 may include any number of elastic cords, straps, links, ropes, chains, or any other elastic mechanism for coupling the first platform 702 to the second platform 704.

In practice, a tension of the elastic coupling 706 may vary based on a position of the first platform 702 relative to the second platform 704. For instance, the elastic coupling 706 may be in a relaxed condition when no external forces are applied to the first platform 702 or the second platform 704, and the elastic coupling 706 may transition to a tensioned condition as the second platform 704 is advanced away from the first platform 702. As noted above, "relaxed condition" refers to a relaxed, un-tensioned condition of the elastic coupling 706 when the first platform 702 and the second platform 704 are not being forced away from one another, and "tensioned condition" refers to a condition of the elastic coupling 706 when the first platform 702 and the second platform 704 are advanced away from each other, thereby increasing a tension or resistance of the elastic coupling 706.

Further, the exercise device 700 may include an adjustment system 716 for adjusting the elastic coupling 706. The adjustment system 716 may include multiple anchor points 718 arranged along one of the side surfaces 710 of the first platform 702. Further, the adjustment system 716 may include one or more anchors 720 coupled to the elastic coupling 706. The anchor 720 may removably couple to one or more of the anchor points 718, and moving the anchor 720 from one anchor point 718 to another anchor point 718 may adjust a tension that is imparted to the elastic coupling 706. For instance, coupling the anchor 720 to an anchor point 718*a* that is proximal to the second platform 704 increases the slack of the elastic coupling 706, such that the elastic coupling 706 may have no tension in the relaxed condition and a low tension in the tensioned condition. Conversely, coupling the anchor 720 to an anchor point 718*b* that is distal from the second platform 704 reduces the slack of the elastic coupling, such that the elastic coupling may have a non-zero tension in the relaxed condition and a higher tension in the tensioned condition. Thus, by moving the anchor 720 closer to the proximal anchor point 718*a*, less force may be required to advance the first platform 702 and the second platform 704 away from one another. And by moving the anchor 720 closer to the distal anchor point 718*b*, greater force may be required to advance the first platform 702 and the second platform 704 away from one another.

As shown, the anchor 720 may include a pin 721, and the anchor points 718 may take the form of a plurality of sockets for receiving the pin 721. However, the adjustment system 716 may be implemented in various ways to allow the anchor 720 to removably couple to the anchor points 718. As an example, the anchor points 718 could include a number of threaded pins, and the anchor 720 could include a threaded socket for engaging the threaded pins. As another example, the anchor points 718 could include a number of threaded sockets, and the anchor 720 could include a threaded pin for engaging the threaded sockets. As yet another example, the anchor 720 could include a cam lever for clamping to the side surface, such that the anchor points 718 include any point where the cam lever is clamped to the side surface. Other examples are possible as well.

As further shown, the adjustment system 716 may include a channel 722 through which the elastic coupling 706 is partially disposed. By arranging the elastic coupling 706 through the channel 722, the channel 722 may help position the elastic coupling 706 such that the elastic coupling 706 at least partially runs along the side surface 710 of the first platform 702. As such, the channel 722 may help prevent the elastic coupling 706 from slipping off the side surface 710 of the first platform 702 and onto the top surface 708 or the bottom surface of the first platform 702. Further, an opening of the channel 722 may be smaller in size than the anchor 720 such that the anchor 720 may not pass through the channel 722. This may help prevent the elastic coupling 706 from completely disengaging from the first platform 702 when the anchor 720 is not coupled to an anchor point 718.

Additionally, the exercise device 700 may include multiple adjustment systems similar to adjustment system 716. For instance, the exercise device 700 may include two adjustment systems on opposing side surfaces of the first platform 702 with each adjustment system configured to adjust a tension of a separate elastic band of the elastic coupling 706. Alternatively or additionally, one or more side surfaces of the second platform 704 may include similar adjustment systems.

Further, because the elastic coupling 706 may have a non-zero tension in the relaxed condition, as noted above, such tension may cause the second platform 704 to tend to fold over on top of the first platform 702. Accordingly, the first platform 702 may include an aperture (not shown) on a side surface of the first platform 702 that is proximal to the second platform 704, and the aperture may be sized for receiving a portion of the second platform 704. In the relaxed condition, the elastic coupling 706 may pull the second platform at least partially into the aperture, thereby causing the first platform 702 and the second platform 704 to interlock such that the second platform 704 does not flip onto the first platform 702.

FIG. 8 next illustrates a bottom view of an exercise device similar to or the same as the exercise device 700 depicted in FIG. 7, according to an example embodiment. The elastic coupling 706 may couple to the second platform 704 in a variety of ways. As shown, for instance, the second platform 704 may include a number of anchor points 802, which may be similar to or different from the anchor points 718 depicted in FIG. 7. As further shown, the anchor points 802 may include protruding pins, and the elastic coupling 706 may include hoops configured to engage the protruding pins. The hoops of the elastic coupling 706 may be elastic hoops designed to stretch over and be secured by caps on the protruding pins. In other examples, the anchor points 802 may include various types of pins or sockets, and the elastic coupling 706 may be coupled to the anchor points 802 by corresponding sockets or pins configured to engage with the anchor points 802. Other male-female and reciprocal connection mechanisms are contemplated as well.

The anchor points 802 may be disposed in a recessed area 804 of the bottom surface 713 of the second platform 704. In this manner, when the bottom surface 713 of the second platform 704 is contacting a support surface 206, the anchor points 802 may not contact the support surface 206. Further, while FIG. 8 depicts the anchor points 802 in a particular arrangement on the bottom surface 713 of the second platform 704, in other examples the anchor points 802 may be arranged differently on one or more other surfaces of the second platform 704.

As further shown by FIG. 8, the bottom surface 709 of the first platform 702 may include a number of standoff surfaces 809*a-d*, such that the standoff surfaces 809*a-d* of the bottom surface 709 are configured to make contact with the support surface 206. In some examples, the bottom surface 713 of the second platform 704 and/or the top surfaces 708, 712 of the first and second platforms 702, 704 may include standoff surfaces as well. Further, in order to facilitate using the exercise device 700 on multiple types of support surfaces 206, the standoff surfaces 809*a-d* may be removable and/or interchangeable with various types of materials designed to grip or slide across various types of support surfaces 206, as discussed above with reference to the top and bottom surfaces of the first and second platforms in FIG. 7.

Figure 9:
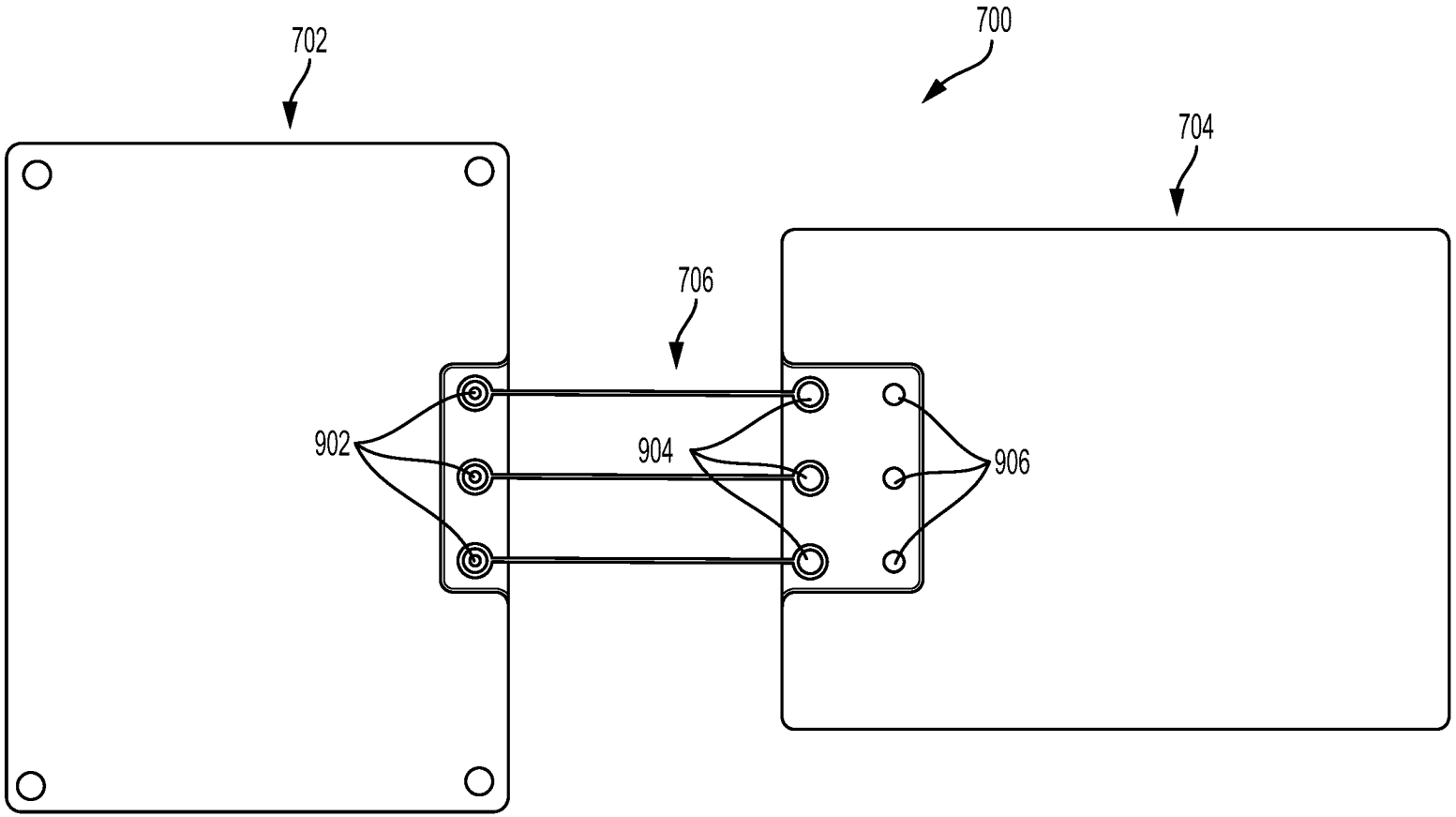
FIG. 9 is a bottom view of the exercise device of FIG. 8, according to another example embodiment.

Referring next to FIG. 9, another example bottom view of the exercise device 700 is illustrated. In particular, FIG. 9 illustrates an alternate configuration for coupling the elastic coupling 706 to the first platform 702 and the second platform 704.

As shown, the elastic coupling 706 may be coupled to a number of anchor points 902 arranged on the first platform 702, similar to the anchor points 802 depicted in FIG. 8. The second platform 704 may then include multiple rows of anchor points including a first row of anchor points 904 and a second row of anchor points 906. In this manner, the elastic coupling 706 may be coupled either to the first row of anchor points 904 or the second row of anchor points 906. Because the second row of anchor points 906 are arranged further away from the first platform 702, coupling the elastic coupling 706 to the second row of anchor points 906 may increase a tension of the elastic coupling 706 and may thus increase an amount of force required to advance the second platform 704 away from the first platform 702.

Additionally, while the exercise device 700 is depicted as having three elastic bands coupled to three anchor points, other examples are possible as well. For instance, the first and second rows of anchor points 904, 906 may each include more or fewer than three anchor points, and the elastic coupling 706 may include more or fewer than three elastic bands to couple to the anchor points. Further, the number of elastic bands coupled to the anchor points may be adjusted in order to further control the amount of force required to advance the second platform 704 away from the first platform 702. For instance, reducing the number of elastic bands may reduce the required force, and increasing the number of elastic bands may increase the required force.

Figure 10:
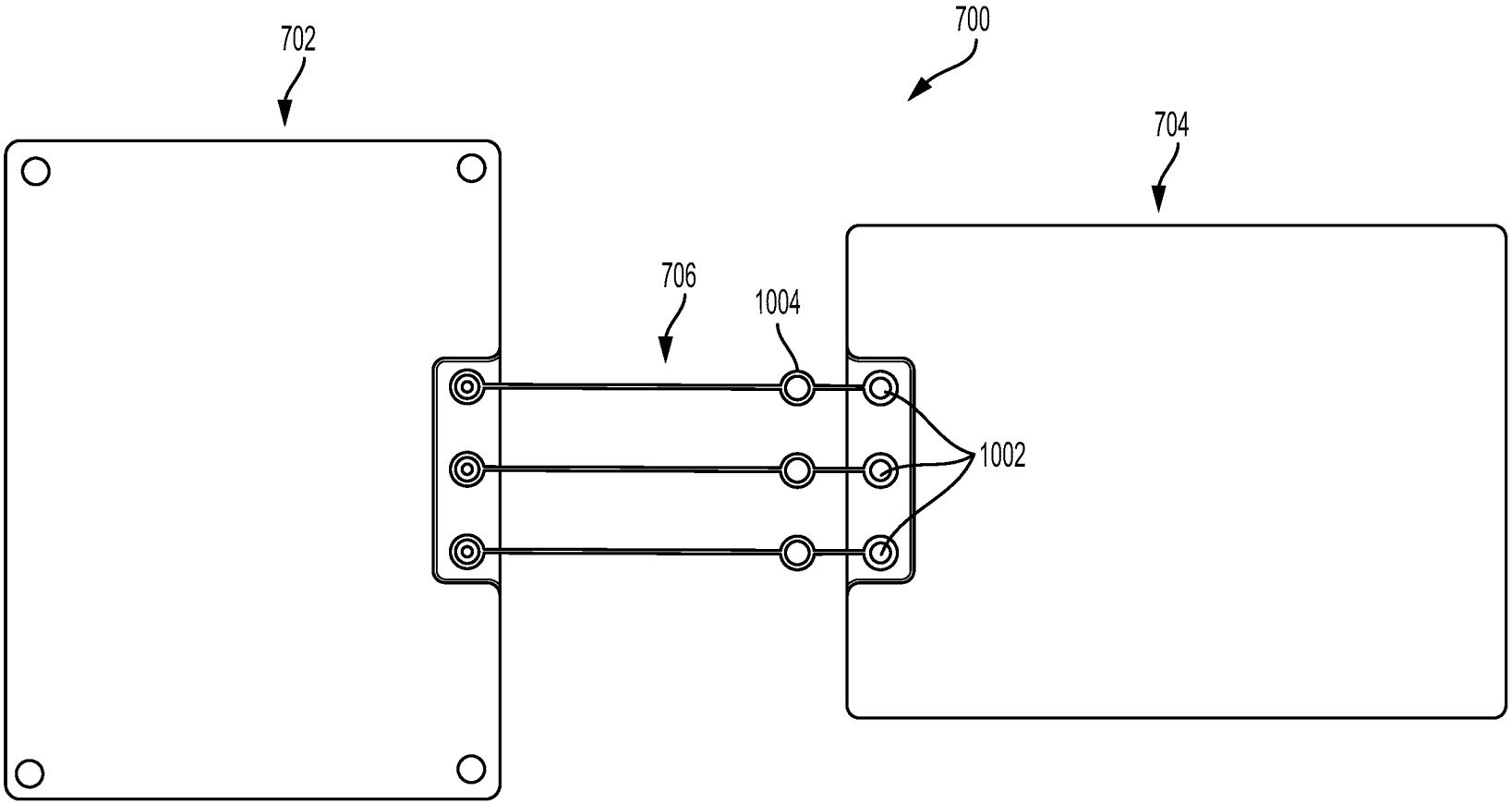
FIG. 10 is a bottom view of the exercise device of FIG. 8, according to another example embodiment.

Referring next to FIG. 10, another example bottom view of the exercise device 700 is illustrated. In particular, FIG. 10 illustrates another alternate configuration for coupling the elastic coupling 706 to the second platform 704.

As shown, instead of including multiple rows of anchor points as depicted in FIG. 9, the second platform 704 may include a single row of anchor points 1002, and each elastic band of the elastic coupling 706 may include multiple anchors 1004 (e.g., elastic hoops) along the length of the band. In this manner, a tension of the elastic bands may be adjusted by changing which anchors 1004 are coupled to the anchor points 1002.

Figure 11:
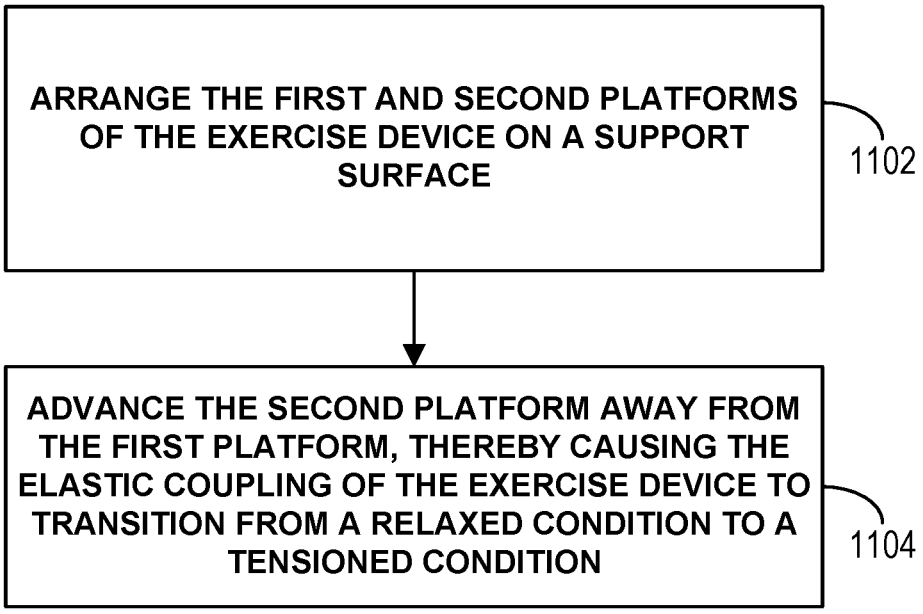
FIG. 11 is a flow chart of a method of exercising, according to an example embodiment.

FIG. 11 is a flow chart of a method of exercising, according to an example embodiment. The method may be carried out using any of the exercise devices disclosed herein, each of which include a first platform, a second platform, and an elastic coupling that couples the first platform to the second platform. At block 1102, the method involves arranging the first platform and the second platform of the exercise device on a support surface. In line with the discussion above, the support surface may be any surface that supports the exercise device, such as a floor or ground surface. Further, when the exercise device is so arranged on the support surface, the first platform may be configured to remain static with respect to the support surface (e.g., based on a high amount of friction between the first platform and the support surface), and the second platform may be configured to be moveable with respect to the support surface (e.g., based on a low amount of friction between the second platform and the support surface or due to the second platform including wheels configured to roll on the support surface).

At block 1104, the method involves advancing the second platform away from the first platform, thereby causing the elastic coupling to transition from a relaxed condition to a tensioned condition. In line with the discussion above, the second platform may be advanced away from the first platform in a variety of ways. For instance, a user may place a first body part of the user on the first platform, place a second body part of the user on the second platform, and advance the second body part away from the first body part, thereby advancing the second platform away from the first platform.

Additionally, when advancing the second platform away from the first platform, the second platform may be moved in a variety of directions. For instance, the second platform may be advanced along a longitudinal axis that extends lengthwise between the first and second platforms. Alternatively or additionally, the second platform may be advanced along a lateral axis that is orthogonal to the longitudinal axis (e.g., side to side). Further, the second platform may be advanced away from the first platform in a diagonal or oblique direction. Other examples are possible as well.

In some examples, the method may further involve coupling a resistance band to the first platform (e.g., by inserting the resistance band into one or more slots located on the sides of the first platform) and performing various resistance band exercises. The resistance band exercises may be performed concurrently while advancing the second platform away from the first platform, or instead of advancing the second platform away from the first platform.

III. Alternative Embodiments

In some examples, any of the exercise devices described herein may further include one or more pads coupled to one or more surfaces of the first and second platforms. The pads may be arranged to provide cushioning when a user advances the platforms away from one another using their body.

In some examples, any of the exercise devices described herein may further include a frame for guiding the movement of the second platform along the longitudinal axis. The frame may couple to one or more side surfaces of the second platform via a sliding track mechanism, for instance, such that advancing the second platform away from the first platform may involve sliding the second platform along the sliding track mechanism. The frame may be telescopic and may include a hinge arranged between the first and second platforms such that the frame may collapse on itself and fold up to increase portability of the exercise device when not in use.

IV. Conclusion

The above detailed description describes various features and functions of the disclosed exercise devices and methods of use with reference to the accompanying figures. While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. An exercise device comprising:

a first platform, wherein a bottom side of the first platform is configured to interface with a support surface, and wherein the first platform includes a resistance band interface for coupling one or more resistance bands to the first platform;

a second platform, wherein a bottom side of the second platform includes one or more wheels configured to interface with the support surface, wherein the second platform includes one or more restraints couplable to the resistance band interface, and wherein coupling the one or more restraints to the resistance band interface secures the first platform to the second platform in a stacked configuration; and an elastic coupling arranged between the first platform and the second platform, the elastic coupling being configured to transition from a relaxed condition to a tensioned condition as the second platform is advanced away from the first platform along the support surface.

2. The exercise device of claim 1, wherein the elastic coupling is removably coupled to the first and second platforms.

3. The exercise device of claim 2, wherein the elastic coupling comprises an elastic band, wherein the first and second platforms each comprise a respective slot for receiving the elastic band, and wherein the elastic band includes respective stoppers configured to abut the respective slots of the first and second platforms when the slots receive the elastic band, thereby securing the elastic band in the slots.

4. The exercise device of claim 1, wherein the resistance band interface comprises one or more slots configured to receive the one or more resistance bands.

5. The exercise device of claim 1, wherein the bottom side of the first platform includes one or more feet configured to remain static when in contact with the support surface, and wherein the one or more wheels of the second platform are configured to roll on the support surface.

6. The exercise device of claim 1, wherein the bottom side of at least one of the first or second platforms includes a receptacle for storing the elastic coupling.

7. The exercise device of claim 1, wherein a top side of the first platform and a top side of the second platform each include a textured surface configured to interface with a foot or shoe of a user of the exercise device.

8. The exercise device of claim 1, wherein a top side or the bottom side of the first platform includes one or more receptacles configured to receive the one or more wheels of the second platform when the first and second platforms are in the stacked configuration.

9. The exercise device of claim 5, wherein a top side or the bottom side of the second platform includes one or more receptacles configured to receive the one or more feet of the first platform when the first and second platforms are in the stacked configuration.

10. The exercise device of claim 1, wherein the resistance band interface comprises (i) a first slot on a first lateral side of the first platform and (ii) a second slot on a second lateral side of the first platform, wherein the one or more restraints comprise (i) a first retractable band couplable to the first slot and (ii) a second retractable band couplable to the second slot, and wherein the first and second retractable bands are configured to retract into the second platform when uncoupled from the first and second slots.

11. A method of exercising using an exercise device that includes (i) a first platform, (ii) a second platform, and (iii) an elastic coupling configured to couple the first platform to the second platform, wherein the first platform includes (i) a bottom side configured to interface with a support surface and (ii) a resistance band interface for coupling one or more resistance bands to the first platform, and wherein the second platform includes (i) a bottom side having one or more wheels configured to interface with the support surface and (ii) one or more restraints couplable to the resistance band interface, the method comprising:

arranging the first and second platforms on the support surface;

advancing the second platform away from the first platform, thereby causing the elastic coupling to transition from a relaxed condition to a tensioned condition; and coupling the one or more restraints of the second platform to the resistance band interface of the first platform, thereby securing the first platform to the second platform in a stacked configuration.

12. The method of claim 11, wherein the elastic coupling comprises an elastic band, and wherein the method further comprises:

attaching a first end of the elastic band to the first platform; and attaching a second end of the elastic band to the second platform.

13. The method of claim 11, further comprising:

coupling a resistance hand to the resistance band interface of the first platform; and performing a resistance band exercise while advancing the second platform away from the first platform.

14. The method of claim 11, wherein advancing the second platform away from the first platform comprises advancing the second platform along a longitudinal axis that extends between the first platform and the second platform.

15. The method of claim 11, wherein advancing the second platform away from the first platform comprises advancing the second platform away from the first platform in an oblique direction.

16. The method of claim 11, wherein advancing the second platform away from the first platform comprises:

placing, by a user, a first body part of the user on the first platform;

placing, by the user, a second body part of the user on the second platform; and advancing, by the user, the second body part away from the first body part, thereby advancing the second platform away from the first platform.

17. The method of claim 16, wherein the first body part is a first foot of the user and the second body part is a second foot of the user, and wherein advancing the second body part away from the first body part comprises performing a leg lunge exercise or a leg split exercise.

18. The method of claim 16, wherein the first body part is a shoulder of the user and the second body part is a foot of the user, and wherein advancing the second body part away from the first body part comprises performing a pelvic lift exercise.

19. The method of claim 16, wherein the first body part is a knee of the user and the second body part is a hand of the user, and wherein advancing the second body part away from the first body part comprises advancing the hand away from the knee, thereby advancing the second platform away from the first platform.

20. The method of claim 16, wherein the first body part is a foot of the user and the second body part is a hand of the user, and wherein advancing the second body part away from the first body part comprises advancing the hand away from the foot, thereby advancing the second platform away from the first platform.

* * * * *